US009818345B2

(12) United States Patent
Shim et al.

(10) Patent No.: US 9,818,345 B2
(45) Date of Patent: Nov. 14, 2017

(54) ORGANIC LIGHT EMITTING DISPLAY DEVICE AND METHOD OF DRIVING THEREOF

(71) Applicant: LG DISPLAY CO., LTD., Seoul (KR)

(72) Inventors: Jong Sik Shim, Goyang-si (KR); Si Kyu Lee, Daejeon (KR)

(73) Assignee: LG DISPLAY CO., LTD., Seoul (KR)

( * ) Notice: Subject to any disclaimer, the term of this patent is extended or adjusted under 35 U.S.C. 154(b) by 420 days.

(21) Appl. No.: 14/494,280

(22) Filed: Sep. 23, 2014

(65) Prior Publication Data

US 2015/0084946 A1 Mar. 26, 2015

(30) Foreign Application Priority Data

Sep. 25, 2013 (KR) ..... 10-2013-0114163

(51) Int. Cl.

| | |
|---|---|
| ***G09G 3/30*** | (2006.01) |
| ***G09G 3/3258*** | (2016.01) |
| ***G09G 3/3291*** | (2016.01) |
| ***G09G 3/3233*** | (2016.01) |

(52) U.S. Cl.

CPC ..... *G09G 3/3258* (2013.01); *G09G 3/3233* (2013.01); *G09G 3/3291* (2013.01); *G09G 2300/0809* (2013.01); *G09G 2310/0218* (2013.01); *G09G 2310/0272* (2013.01); *G09G 2310/08* (2013.01); *G09G 2320/0295* (2013.01); *G09G 2320/043* (2013.01)

(58) Field of Classification Search

CPC ..... G09G 3/3258; G09G 3/3291; G09G 2300/0809

USPC ..... 345/76, 82, 212

See application file for complete search history.

(56) References Cited

U.S. PATENT DOCUMENTS

| | | | | |
|---|---|---|---|---|
| 2006/0007072 | A1 | 1/2006 | Choi et al. | |
| 2006/0119548 | A1* | 6/2006 | Lan | G09G 3/3233 345/76 |
| 2010/0073335 | A1* | 3/2010 | Min | G09G 3/3233 345/204 |
| 2011/0122324 | A1* | 5/2011 | Yamashita | G09G 3/3233 348/739 |
| 2012/0098810 | A1* | 4/2012 | Nieh | G09G 3/3233 345/211 |

(Continued)

FOREIGN PATENT DOCUMENTS

JP 2009063607 A 3/2009

*Primary Examiner* — Jonathan Blancha
(74) *Attorney, Agent, or Firm* — Dentons US LLP

(57) ABSTRACT

Disclosed is an organic light emitting display device. The organic light emitting display includes a display panel including a plurality of pixels, which are respectively formed in a plurality of pixel areas defined by crossings of a plurality of gate lines and a plurality of data lines, a plurality of sensing lines, and a plurality of second gate voltage lines connected to the plurality of pixels, a panel driver to drive the display panel in a display mode or a sensing mode, to sense a threshold voltage of at least one transistor to generate a sensing data in the sensing mode, and generate a second gate voltage data in the display mode, and a voltage supply unit to generate a second gate electrode voltage corresponding to the second gate voltage data, and apply a second gate electrode voltage to a second gate electrode of the transistor.

17 Claims, 8 Drawing Sheets

(56) References Cited

U.S. PATENT DOCUMENTS

| | | | | |
|---|---|---|---|---|
| 2012/0249510 | A1* | 10/2012 | Jankovic | G09G 3/3233 345/211 |
| 2013/0050292 | A1 | 2/2013 | Mizukoshi | |
| 2013/0063413 | A1* | 3/2013 | Miyake | G09G 3/32 345/212 |
| 2013/0162617 | A1 | 6/2013 | Yoon et al. | |

* cited by examiner

ORGANIC LIGHT EMITTING DISPLAY DEVICE AND METHOD OF DRIVING THEREOF

CROSS-REFERENCE TO RELATED APPLICATION

This application claims the benefit of the Korean Patent Application No. 10-2013-0114163 filed on Sep. 25, 2013, which is hereby incorporated by reference for all purposes as if fully set forth herein.

BACKGROUND

Field of the Disclosure

Embodiments of the present invention relate to a flat panel display (FPD) device. More particularly, the embodiments relate to an organic light emitting display device including a thin film transistor (TFT).

Discussion of the Related Art

Because of advantages such as a thin profile, lighting thereof and low power consumption, flat panel display devices are widely used. In the flat panel display devices, a liquid crystal display (LCD) device and an organic light emitting display device including a thin film transistor (TFT) are good in resolution, color display, and image quality, and thus are commercialized as display devices for notebook computers, tablet computers, and desktop computers. In particular, the organic light emitting display device has a fast response time and low power consumption, and have no limitation in a viewing angle because the organic light emitting display device is a self-emitting light. Accordingly, the organic light emitting display device is attracting much attention as next generation FPD devices.

A general organic light emitting display device includes a display panel including a plurality of pixels and a panel driver that emits light from each of the plurality of pixels. Here, the plurality of pixels are respectively formed in a plurality of pixel areas defined by intersections between a plurality of data lines and a plurality of gate lines.

Each of the plurality of pixels, as illustrated in FIG. 1, includes a switching transistor Tsw, a driving transistor Tdr, a capacitor Cst, and an organic light emitting element OLED.

The switching transistor Tsw is turned on according to a gate signal GS supplied to a gate lines GL, and supplies a data voltage Vdata, supplied to a data line DL, to the driving transistor Tdr.

The driving transistor Tdr is turned on with the data voltage Vdata supplied from the switching transistor Tsw, and controls a data current Ioled flowing to the organic light emitting element OLED with a driving voltage VDD.

The capacitor Cst is connected between a gate and source of the driving transistor Tdr, stores a voltage corresponding to the data voltage Vdata supplied to the gate of the driving transistor Tdr, and turns on the driving transistor Tdr with the stored voltage.

The organic light emitting element OLED is electrically connected between the source of the driving transistor Tdr and a cathode electrode receiving a cathode voltage VSS, and emits light with the data current Ioled supplied from the driving transistor Tdr.

Each pixel of the general organic light emitting display device controls a level of the data current Ioled, which flows to the light emitting element OLED with the driving voltage VDD, with a switching time of the driving transistor Tdr based on the data voltage Vdata to emit light from the light emitting element OLED, thereby displaying an image.

However, in the general organic light emitting display device, due to a non-uniformity of a manufacturing process of a thin film transistor (TFT), a threshold voltage "Vth" of each of the transistors Tdr and Tsw (particularly, the driving transistor Tdr) is shown differently for each pixel. Therefore, in the general organic light emitting display device, the reliability of the TFT and display panel is reduced due to the initial scattering or sequential shift of a threshold voltage of the TFT included in each pixel.

SUMMARY

Accordingly, embodiments of the present invention are directed to an organic light emitting display device that substantially obviates one or more problems due to limitations and disadvantages of the related art.

An aspect of the present invention is directed to provide an organic light emitting display device for enhancing the reliability of a thin film transistor.

In addition to the aforesaid objects of the present invention, other features and advantages of the embodiments of the present invention will be set forth in part in the description below which follows and in part will become apparent to those having ordinary skill in the art upon examination of the following or may be learned from practice of embodiments of the invention. These and other advantages of embodiments of the invention may be realized and attained by the structure particularly pointed out in the written description and claims hereof as well as the appended drawings.

To achieve these and other advantages and in accordance with the purpose of the invention, as embodied and broadly described herein, there is provided an organic light emitting display device including: a display panel including a plurality of pixels, which are respectively formed in a plurality of pixel areas defined by crossing of a plurality of gate lines and a plurality of data lines, a plurality of sensing lines, and a plurality of second gate voltage lines connected to the plurality of pixels, wherein each of the plurality of pixels includes at least one transistor including first and second gate electrodes which overlap each other with a semiconductor layer therebetween; a panel driver to drive the display panel in a display mode or a sensing mode, to sense a threshold voltage of the at least one transistor included in each of the plurality of pixels through the plurality of sensing lines to generate a sensing data in the sensing mode, and generate second gate voltage data based on the sensing data of each pixel in the display mode; and a voltage supply unit to generate a second gate electrode voltage corresponding to the second gate voltage data supplied from the panel driver, and apply the second gate electrode voltage to the second gate electrode of the at least one transistor, included in each pixel, through a corresponding second gate voltage line.

The panel driver may correct input data of each pixel to correction data through data correction based on the sensing data of each pixel, and display the correction data in each pixel. The panel driver may detect a threshold voltage shift of the at least one transistor from the sensing data, and when the detected threshold voltage shift of the at least one transistor deviates from a compensation range based on the data correction, the panel driver may generate the second gate voltage data.

To achieve these and other advantages and in accordance with the purpose of embodiments of the invention, as embodied and broadly described herein, there is also provided a method of driving an organic light emitting display device comprising, supplying a first gate signal GSa and a second gate signal GSb, having a gate-on voltage level, to a first gate signal line GLa and a second gate signal line GLb of an ith gate line GLi according to a gate driver respectively, supplying a sensing data voltage Vdata_sen to an ith data line DLi according to a data driver and simultaneously supplying a precharging voltage Vpre to an ith sensing line SLi, where a first switching transistor T1 and a second switching transistor T2 of an ith pixel P are respectively turned on by the first and second gate signals GSa and GSb and, where the sensing data voltage Vdata_sen is supplied to a first node n1, and the precharging voltage Vpre is supplied to a second node n2.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiments of the invention and together with the description serve to explain the principle of the invention. In the drawings.

DETAILED DESCRIPTION OF THE ILLUSTRATED EMBODIMENTS

Reference will now be made in detail to the exemplary embodiments of the present invention, examples of which are illustrated in the accompanying drawings. Wherever possible, the same reference numbers will be used throughout the drawings to refer to the same or like parts.

The terms described in the specification should be understood as follows.

As used herein, the singular forms "a", "an" and "the" are intended to include the plural forms as well, unless the context clearly indicates otherwise. The terms "first" and "second" are for differentiating one element from the other element, and these elements should not be limited by these terms.

It will be further understood that the terms "comprises", "comprising,", "has", "having", "includes" and/or "including", when used herein, specify the presence of stated features, integers, steps, operations, elements, and/or components, but do not preclude the presence or addition of one or more other features, integers, steps, operations, elements, components, and/or groups thereof.

The term "at least one" should be understood as including any and all combinations of one or more of the associated listed items. For example, the meaning of "at least one of a first item, a second item, and a third item" denotes the combination of all items proposed from two or more of the first item, the second item, and the third item as well as the first item, the second item, or the third item.

The term "on" should be construed as including a case where one element is formed at a top of another element and moreover a case where a third element is disposed therebetween.

Hereinafter, an organic light emitting display device according to embodiments of the present invention will be described in detail with reference to the accompanying drawings.

Figure 1:
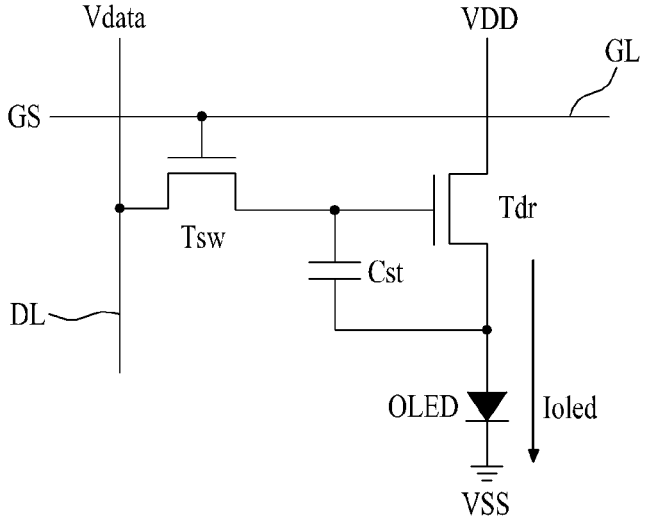
FIG. 1 Related Art
FIG. 1 is a diagram for describing a pixel structure of a general organic light emitting display device.
Figure 2:
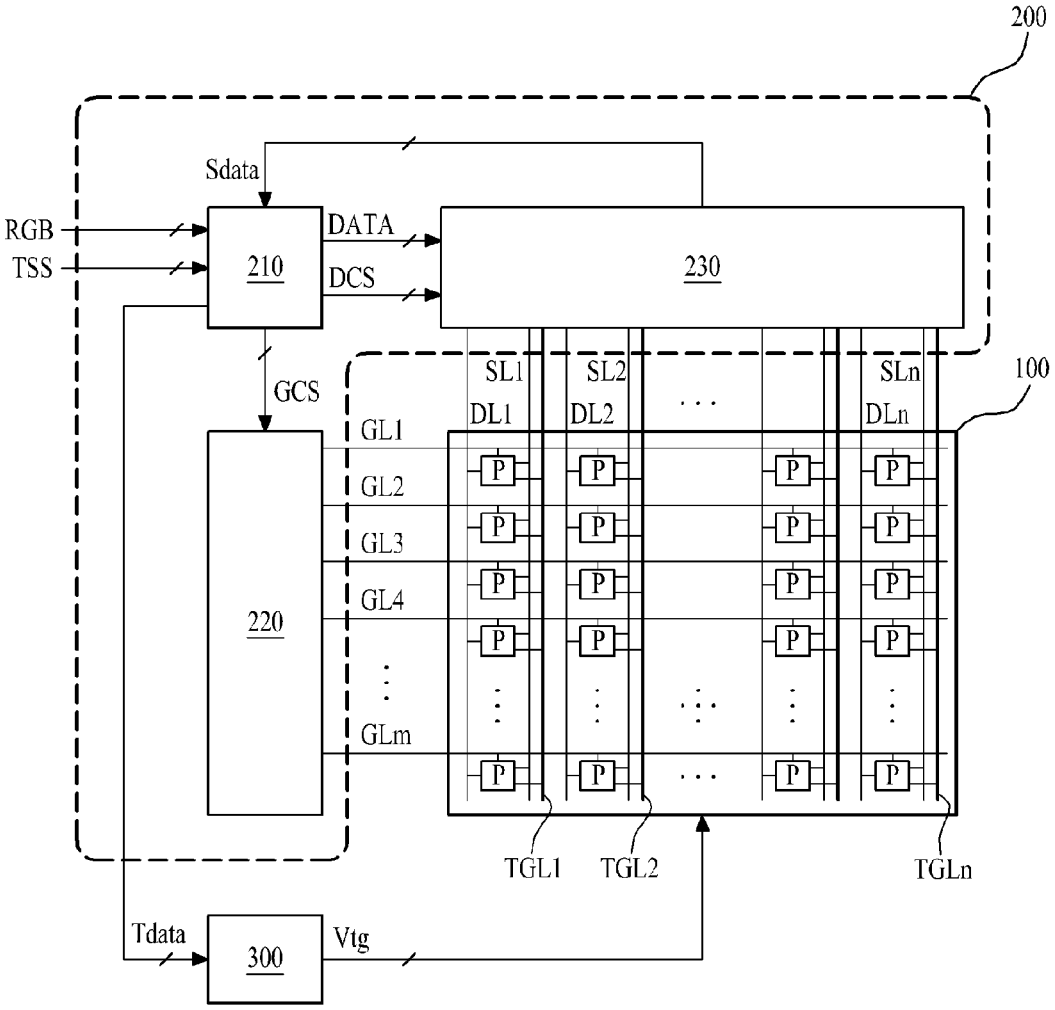
FIG. 2 is a diagram for describing an organic light emitting display device according to a first embodiment of the present invention.
Figure 3:
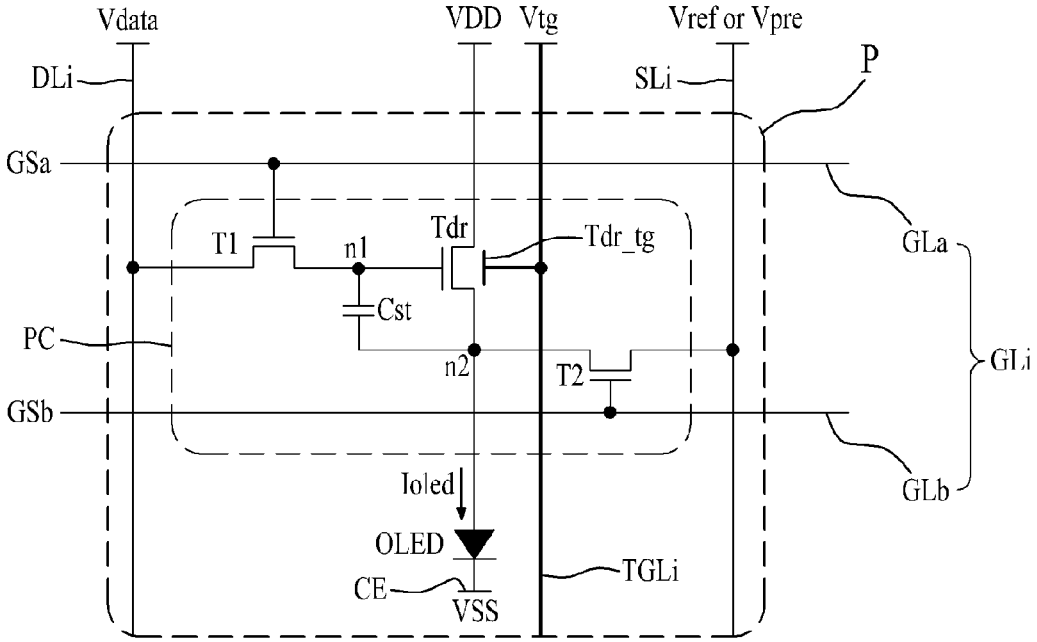
FIG. 3 is a diagram for describing a structure of an ith pixel of FIG. 2.
Figure 4:
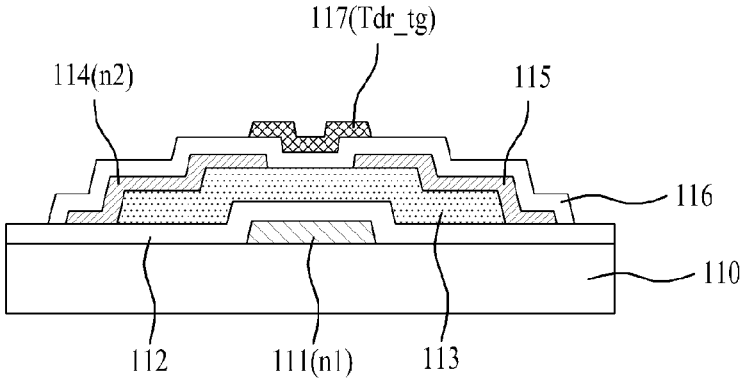
FIG. 4 is a cross-sectional view for describing a structure of a driving transistor of FIG. 3.

FIG. 2 is a diagram for describing an organic light emitting display device according to a first embodiment of the present invention. FIG. 3 is a diagram for describing a structure of an ith pixel of FIG. 2. FIG. 4 is a cross-sectional view for describing a structure of a driving transistor of FIG. 3.

Referring to FIGS. 2 to 4, the organic light emitting display device according to the first embodiment of the present invention includes a display panel 100, a panel driver 200, and a voltage supply unit 300.

The display panel 100 includes a plurality of data lines DL1 to DLn, a plurality of gate lines GL1 to GLm, a plurality of upper gate voltage lines TGL1 to TGLn (or a plurality of second gate voltage lines), a plurality of sensing lines SL1 to SLn, and a plurality of pixels P.

The plurality of data lines DL1 to DLn are arranged at certain intervals in the display panel 100. When the display panel 100 operates in a display mode, each of the plurality of data lines DL1 to DLn may be used to supply a data voltage to a corresponding pixel P, and when the display panel 100 operates in a sensing mode, each of the plurality of data lines DL1 to DLn may be used to supply a sensing data voltage to a corresponding pixel P.

The plurality of gate lines GL1 to GLm are arranged at certain intervals in the display panel 100 to intersect the plurality of data lines DL1 to DLn. Here, each of the plurality of gate lines GL1 to GLm may include first and second gate signal lines GLa and GLb.

The plurality of upper gate voltage lines TGL1 to TGLm are arranged at certain intervals in the display panel 100 so as to be parallel to the plurality of data lines DL1 to DLn.

The plurality of sensing lines SL1 to SLn are arranged at certain intervals in the display panel 100 so as to be parallel to the plurality of data lines DL1 to DLn. When the display panel 100 operates in the display mode, each of the plurality of sensing lines SL1 to SLn is used to supply a reference voltage to a corresponding pixel P, and when the display panel 100 operates in the sensing mode, each of the plurality of sensing lines SL1 to SLn is used to sense a characteristic change of a corresponding pixel P.

Each of the plurality of pixels P may be one of a red pixel, a green pixel, a blue pixel, and a white pixel. One unit pixel displaying one image may include adjacent red pixel, green pixel, blue pixel, and white pixel, or may include adjacent red pixel, green pixel, and blue pixel without being limited thereto.

The plurality of pixels P are respectively formed in a plurality of intersection areas between the plurality of data lines DL1 to DLn and the plurality of gate lines GL1 to GLm, and emit light with a data current corresponding to a difference in the voltage between a data voltage Vdata supplied to each of the data lines DL1 to DLn and a reference voltage Vref supplied to each of the sensing lines SL1 to SLn according to first and second gate signals GSa and GSb supplied to each of the gate lines GL1 to GLm, thereby displaying an image. To this end, each of the pixels P includes an organic light emitting element OLED and a pixel circuit PC.

The organic light emitting element OLED emits light with a data current Ioled supplied to the pixel circuit PC to emit light of luminance corresponding to the data current. To this end, the organic light emitting element OLED includes an anode electrode connected to the pixel circuit PC, an organic layer (not shown) formed on the anode electrode, and a cathode electrode CE which is formed on the organic layer and receives a cathode voltage VSS. Here, the organic layer may be formed to have a structure of a hole transport layer/organic emission layer/electron transport layer or a structure of a hole injection layer/hole transport layer/organic emission layer/electron transport layer/electron injection layer. Furthermore, the organic layer may further include a function layer for enhancing the emission efficiency and/or service life of the organic emission layer.

The pixel circuit PC includes a first switching transistor T1, a second switching transistor T2, a driving transistor Tdr, and a capacitor Cst.

The first switching transistor T1 includes a gate electrode connected to a first gate signal line GLa, a source electrode connected to an adjacent data line DLi, and a drain electrode connected to a first node n1 that is a gate electrode of the driving transistor Tdr. The first switching transistor T1 supplies the data voltage Vdata, which is supplied to the data line DLi, to the first node n1 (i.e., the gate electrode of the driving transistor Tdr) according to a gate signal supplied to the first gate signal line GLa.

The second switching transistor T2 includes a gate electrode connected to a second gate signal line GLb, a drain electrode connected to a second node n2 that is a source electrode of the driving transistor Tdr, and a source electrode connected to an adjacent sensing line SLi. The second switching transistor T2 is turned on according to the gate signal supplied to the second gate signal line GLb, and connects the sensing line SLi to the second node n2 (i.e., the source electrode of the driving transistor Tdr). In the sensing mode, the second switching transistor T2 connects the second node n2 of a corresponding pixel P to the sensing line SLi, thereby allowing a current, flowing in the corresponding pixel P, to flow to the sensing line SLi.

The storage capacitor Cst includes first and second electrodes connected between the gate electrode and source electrode of the driving transistor Tdr, namely, the first and second electrodes connected between the first and second nodes n1 and n2. The storage capacitor Cst is charged with a difference voltage between voltages respectively supplied to the first and second nodes n1 and n2, and turns on the driving transistor Tdr with the charged voltage.

The driving transistor Tdr is turned on with the voltage of the storage capacitor Cst, and controls an amount of current that flows from a driving voltage VDD line to the organic light emitting element OLED. To this end, the driving transistor Tdr includes a lower gate electrode 111 (or a first gate electrode), a gate insulating layer 112, a semiconductor layer 113, a source electrode 114, a drain electrode 115, a protective layer 116, and an upper gate electrode 117 (or a second gate electrode).

The lower gate electrode 111 is formed on a transistor array substrate 110 of the display panel 100, and is connected in common to the first node n1 (i.e., the drain electrode of the first switching transistor T1) and a first electrode of the storage capacitor Cst.

The gate insulating layer 112 is formed on the lower substrate 110 so as to cover the lower gate electrode 111.

The semiconductor layer 113 is formed on the gate insulating layer 112 so as to overlap the lower gate electrode 111. The semiconductor layer 113 may be formed of amorphous silicon (a-Si), polycrystalline silicon (poly-Si), oxide, or an organic material. Here, the oxide semiconductor layer 113 may be formed of oxide such as zinc oxide, tin oxide, Ga—In—Zn oxide, In—Zn oxide, or In—Sn oxide, or may be formed of oxide in which ions of Al, Ni, Cu, Ta, Mo, Zr, V, Hf, or Ti are doped on the oxide.

The source electrode 114 is formed at one side of the semiconductor layer 113 overlapping the lower gate electrode 111, and is connected in common to the second node n2 (i.e., the drain electrode of the second switching transistor T2 and a second electrode of the storage capacitor Cst) and an anode electrode of the organic light emitting element OLED.

The drain electrode 115 is formed at the other side of the semiconductor layer 113 overlapping the lower gate electrode 111 so as to be separated from the source electrode 114, and is connected to the driving voltage VDD line.

The protective layer 116 is formed on the transistor array substrate 110 so as to cover the semiconductor layer 113, the source electrode 114, and the drain electrode 115.

The upper gate electrode 117 (Tdr_tg) is formed on the protective layer 116 so as to overlap all or a portion of the lower gate electrode 111, and is connected to an adjacent upper gate voltage line TGLi. An upper gate voltage Vtg (or a second gate electrode voltage) is supplied from the upper gate voltage line TGLi to the upper gate electrode 117 (Tdr_tg).

Figure 5:
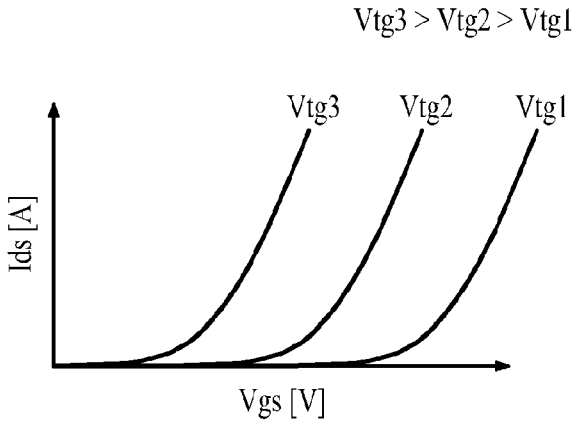
FIG. 5 is a diagram for describing a gate-source voltage characteristic based on an upper gate voltage, in a transistor included in each pixel formed in a display panel of FIG. 2.
Figure 6:
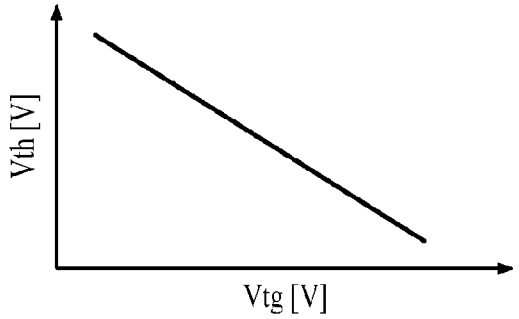
FIG. 6 is a diagram for describing a threshold voltage shift based on the upper gate voltage, in the transistor included in each pixel formed in the display panel of FIG. 2.

A threshold voltage Vth of the driving transistor Tdr is shifted according to a voltage applied to the lower gate electrode 111 and the upper gate electrode 117 (Tdr_tg) which are formed to overlap each other with the semiconductor layer 113 therebetween. In detail, as seen in FIGS. 5 and 6, the driving transistor Tdr including the upper gate electrode 117 (Tdr_tg) has a characteristic in which a gate-source voltage Vgs becomes lower as a voltage level of the upper gate voltage Vtg becomes higher, and the threshold voltage Vth of the driving transistor Tdr has a characteristic which becomes lower as a level of the upper gate voltage Vtg becomes higher. Therefore, the threshold voltage Vth of the driving transistor Tdr is shifted to have a negative correlation with the upper gate voltage Vtg supplied to the upper gate electrode 117 (Tdr_tg).

The panel driver 200 drives the display panel 100 in the sensing mode or the display mode. In the sensing mode, the panel driver 200 senses, through each of the plurality of sensing lines SL1 to SLn, the threshold voltage of the driving transistor Tdr included in each pixel P to generate sensing data Sdata, and corrects input data RGB of each pixel P on the basis of the sensing data Sdata to display the corrected data in each pixel P. In the display mode, the panel driver 200 generates upper gate voltage data Tdata (or second gate voltage data) for restoring the threshold voltage of the driving transistor Tdr (included in each pixel P) to a normal compensation range, based on the sensing data Sdata, and supplies the upper gate voltage data Tdata to the voltage supply unit 300. To this end, the panel driver 200 includes a timing controller 210, a gate driver 220, and a data driver 230.

The timing controller 210 operates the gate driver 220 and the data driver 230 in the display mode. At an external compensation time, the timing controller 210 operates the gate driver 220 and the data driver 230 in the sensing mode. Here, in performing inspection before a finished organic light emitting display device is released, the sensing mode may be performed when the display panel is initially driven, when the display panel 100 is driven for a long time and then is ended, or in a blank period of a frame which is set in real time or periodically.

In the display mode, the timing controller 210 corrects data based on the sensing data Sdata of each pixel P stored in a memory (not shown) to correct input data RGB, which are input from a system body (not shown) or a graphics card (not shown), to correction data. The timing controller 210 aligns the correction data so as to be suitable for driving of the display panel 100, and supplies the aligned data to the data driver 230. The timing controller 210 generates a data control signal DCS and a gate control signal GCS, which are based on the display mode, by using a timing synch signal TSS input thereto to operate the gate driver 220 and the data driver 230 in the display mode.

In the display mode, the timing controller 210 generates the upper gate voltage data Tdata for restoring the threshold voltage of the driving transistor Tdr (included in each pixel P) to the normal compensation range, based on the sensing data Sdata of each pixel P stored in a memory (not shown), and supplies the upper gate voltage data Tdata to the voltage supply unit 300. In this case, the timing controller 210 generates the upper gate voltage data Tdata for separately setting the upper gate voltage Vtg which is to be supplied to each of the upper gate voltage lines TGL1 to TGLn, based on the sensing data Sdata of each pixel P connected to a corresponding upper gate voltage line.

Figure 7:
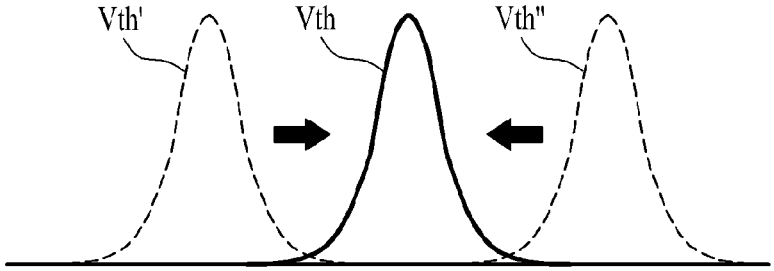
FIG. 7 is a diagram for describing restoration of a threshold voltage shift of the transistor included in each pixel formed in the display panel of FIG. 2

In detail, a threshold voltage shift of the driving transistor Tdr included in each pixel P may be compensated for by correcting data based on the sensing data Sdata of each pixel P, but when the threshold voltage shift is equal to or greater than a certain voltage, the threshold voltage shift cannot be compensated for through data correction. Therefore, as illustrated in FIG. 7, the timing controller 210 detects threshold voltages Vth' and Vth" of the driving transistor Tdr included in each pixel P on the basis of the sensing data Sdata of each pixel P, and generates the upper gate voltage data Tdata for restoring a corresponding threshold voltage to a threshold voltage, which is within the normal compensation range, according to a certain algorithm based on the threshold voltages Vth' and Vth" which deviate from the normal compensation range among the detected threshold voltages Vth' and Vth". For example, the timing controller 210 may detect the threshold voltages Vth' and Vth" of the driving transistors Tdr respectively connected to the plurality of upper gate voltage lines TGL1 to TGLn on the basis of the sensing data Sdata of each pixel P, and generate the upper gate voltage data Tdata for restoring a corresponding threshold voltage to a threshold voltage, based on one (or an average value) of pieces of sensing data Sdata corresponding to the threshold voltages Vth' and Vth" which deviate from the normal compensation range among the detected threshold voltages Vth' and Vth".

In the sensing mode, the timing controller 210 generates sensing input data, and supplies the sensing input data to the data driver 230. The timing controller 210 generates a data control signal DCS and a gate control signal GCS, which are based on the sensing mode, to drive the gate driver 220 and the data driver 230 in the sensing mode. In the sensing mode, the timing controller 210 stores the sensing data Sdata of each pixel P, supplied from the data driver 230, in the memory.

The gate driver 220 sequentially generates the first and second gate signals GSa and GSb according to the gate control signal GCS supplied from the timing controller 210, and sequentially supplies the first and second gate signals GSa and GSb to the first and second gate signal lines GLa and GLb of each of the plurality of gate lines GL1 to GLm, respectively. The gate driver 220 may include a shift register that sequentially generates the first and second gate signals GSa and GSb. The shift register may be provided as a semiconductor chip type, or may be built into a non-display area of one side or non-display areas of both sides of the transistor array substrate of the display panel 100 simultaneously with a TFT manufacturing process of forming each pixel P. Here, the gate driver 220 may include a plurality of gate driving integrated circuits (ICs) (not shown), which are each formed as a semiconductor chip type, and a plurality of gate flexible films (not shown) on which the plurality of gate driving ICs are respectively mounted. The plurality of gate flexible films may be adhered to a gate pad part which is provided on the transistor array substrate of the display panel 100, and thus, the plurality of gate driving ICs may be connected to the plurality of gate lines GL1 to GLm through a corresponding gate flexible film and the gate pad part.

Figure 8:
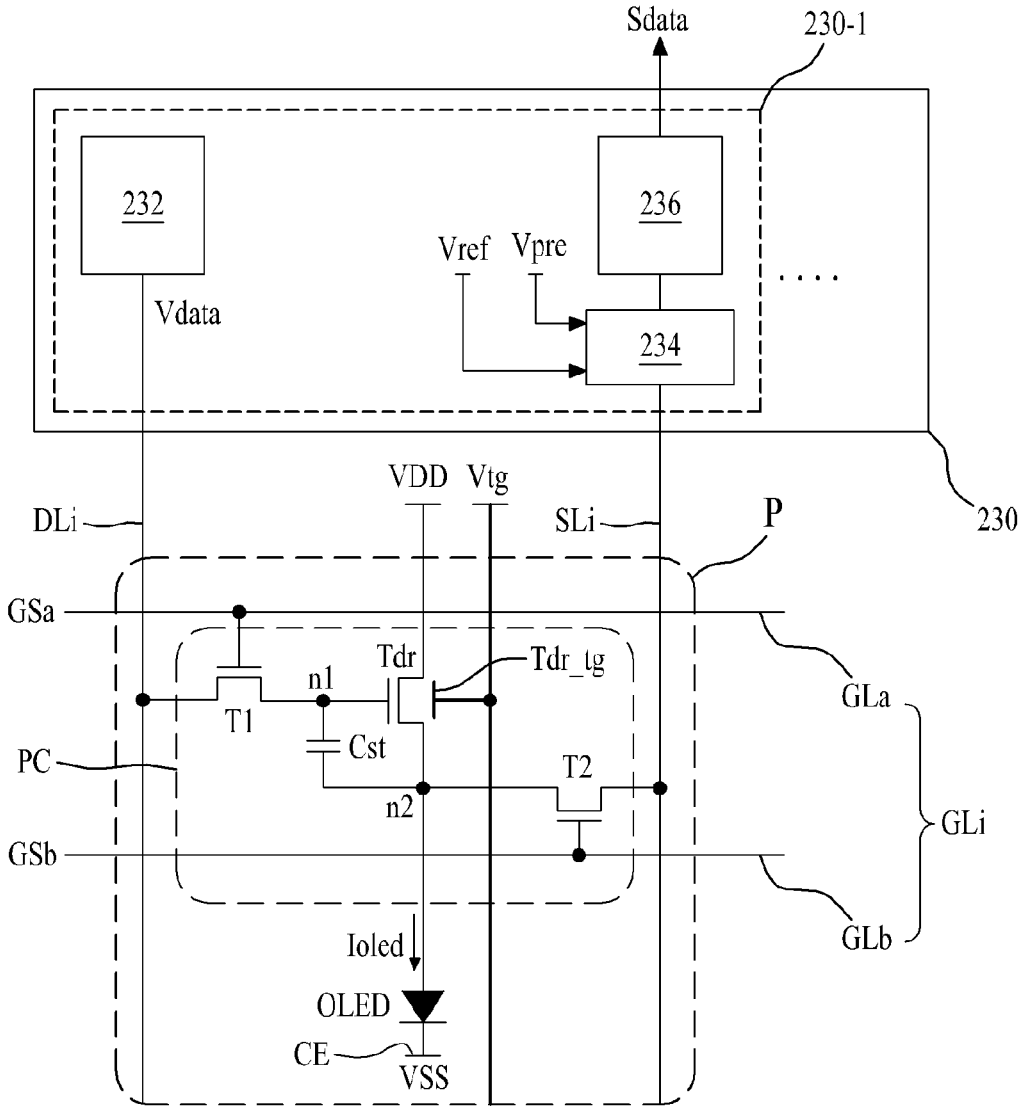
FIG. 8 is a diagram for describing a data driver of FIG. 2.

The data driver 230 converts input display data DATA into analog data voltages Vdata in response to a control of the timing controller 210 based on the display mode to respectively supply the analog data voltages to the data lines DL1 to DLn, and simultaneously supplies the reference voltage Vref to the sensing lines SL1 to SLn. Also, the data driver 230 senses the threshold voltage Vth of the driving transistor included in each pixel P in response to a control of the timing controller 210 based on the sensing mode to generate the sensing data Sdata, and supplies the sensing data Sdata to the timing controller 210. To this end, as illustrated in FIG. 8, the data driver 230 includes a data voltage supply unit 232, a switching unit 234, and a sensing data generator 236.

The data voltage supply unit 232 converts display data DATA, supplied from the timing controller 210, into a data voltage Vdata, and supplies the data voltage Vdata to the data line DLi. In the sensing mode, the data voltage supply unit 232 converts sensing input data, supplied from the timing controller 210, into a sensing data voltage Vdata, and supplies the sensing data voltage Vdata to the data line DLi. To this end, the data voltage supply unit 232 includes a shift register that generates a sampling signal on the basis of a data start signal and a data shift signal, a latch that latches the input data DATA supplied from the timing controller 210 according to the sampling signal, a grayscale voltage generator that generates a plurality of grayscale voltages by using a plurality of reference gamma voltages, a digital-to-analog converter (DAC) that selects and outputs a grayscale voltage, corresponding to the latched data among the plurality of grayscale voltages, as a data voltage Vdata, and an output unit that outputs the data voltage Vdata according to a data output signal included in the data control signal DCS.

In the display mode, the switching unit 234 supplies the reference voltage Vref to the sensing line SLi according to a control of the timing controller 210. In the sensing mode, the switching unit 234 supplies a precharging voltage Vpre to the sensing line SLi according to a control of the timing controller 210, floats the sensing line SLi, and connects the sensing line SLi to the sensing data generator 236. For example, the switching unit 236 may be configured with a de-multiplexer.

In the sensing mode, the sensing data generator 236 is connected to the sensing line SLi by the switching unit 234, senses a voltage charged into the sensing line SLi, and converts the sensed voltage into digital sensing data Sdata to supply the digital sensing data Sdata to the timing controller 210.

The data driver 230 may include a plurality of data driving ICs 230-1, in which the data voltage supply unit 232, the switching unit 234, and the sensing data generator 236 are integrated into one semiconductor chip, and a plurality of data flexible films (not shown) on which the plurality of data driving ICs are respectively mounted. The plurality of data flexible films may be adhered to a data pad part which is provided on the transistor array substrate of the display panel 100, and thus, the plurality of data driving ICs 230-1 may be connected to the plurality of data lines DL1 to DLn through a corresponding data flexible film and the data pad part.

Referring again to FIGS. 2 to 4, the voltage supply unit 300 generates the upper gate voltage Vtg corresponding to the upper gate voltage data Tdata supplied from the timing controller 210, and supplies the upper gate voltage Vtg to each of the upper gate voltage lines TGL1 to TGLn. Therefore, the upper gate voltage Vtg is applied to the upper gate electrode Tdr_tg of the driving transistor Tdr of a corresponding pixel P through a corresponding upper gate voltage line, and thus, the threshold voltage Vth of the driving transistor Tdr is shifted to have a negative correlation with the upper gate voltage Vtg, whereby the threshold voltage is restored to the normal compensation range.

According to an embodiment of the present invention, the voltage supply unit 300 may be connected to the plurality of upper gate voltage lines TGL1 to TGLn through the data flexible film of the data driver 230.

According to another embodiment of the present invention, the voltage supply unit 300 may be connected to the plurality of upper gate voltage lines TGL1 to TGLn through the gate flexible film of the gate driver 220.

According to another embodiment of the present invention, the voltage supply unit 300 may be connected to the plurality of upper gate voltage lines TGL1 to TGLn through at least one voltage supply film (not shown) adhered to an upper gate voltage pad part (not shown) which is provided on the transistor array substrate of the display panel 100. In this case, the voltage supply film (not shown) may be adhered to the upper gate voltage pad part (not shown) which is provided on the transistor array substrate of the display panel 100 to which the data flexible film of the data driver 230 is not adhered.

Figure 9:
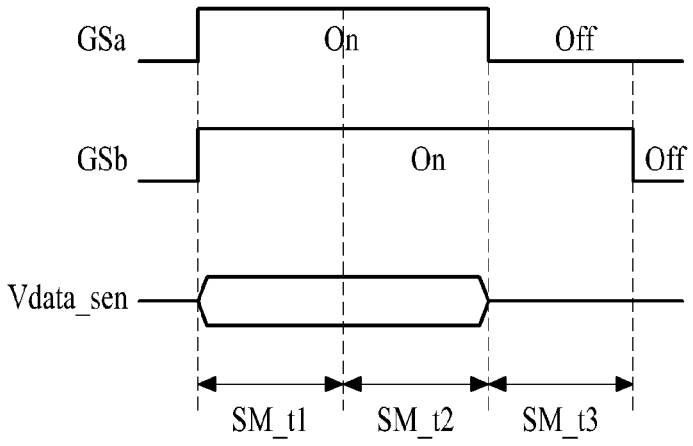
FIG. 9 is a waveform diagram showing a driving waveform in a sensing mode of an organic light emitting display device according to an embodiment of the present invention.

FIG. 9 is a waveform diagram showing a driving waveform in a sensing mode of an organic light emitting display device according to an embodiment of the present invention.

Driving of a pixel P connected to a ith gate line GLi in the sensing mode will be described with reference to FIGS. 2, 8 and 9. In the sensing mode, the pixel P connected to the ith gate line GLi is driven in a precharging period SM_t1, a charging period SM_t2, and a sensing period SM_t3.

In the precharging period SM_t1, the first and second gate signals GSa and GSb having a gate-on voltage level are respectively supplied to the first and second gate signal lines GLa and GLb of the ith gate line GLi according to driving of the gate driver 220, a sensing data voltage Vdata_sen is supplied to an ith data line DLi according to driving of the data driver 230, and simultaneously, a precharging voltage Vpre is supplied to an ith sensing line SLi. Therefore, the first and second switching transistors T1 and T2 of an ith pixel P are respectively turned on by the first and second gate signals GSa and GSb, and thus, the sensing data voltage Vdata_sen is supplied to the first node n1, and the precharging voltage Vpre is supplied to the second node n2. Therefore, in the precharging period SM_t1, the capacitor Cst is precharged with a difference voltage "Vdata_sen−Vpre" between the sensing data voltage Vdata_sen and the precharging voltage Vpre.

Subsequently, in the charging period SM_t2, the first and second gate signals GSa and GSb having the gate-on voltage level are respectively supplied to the first and second gate signal lines GLa and GLb of the ith gate line GLi according to driving of the gate driver 220, a sensing data voltage Vdata_sen is continuously supplied to an ith data line DLi according to driving of the data driver 230, and the ith sensing line SLi is floated by the switching unit 234 of the data driver 230. Therefore, in the charging period SM_t2, the driving transistor Tdr is turned on by the sensing data voltage Vdata_sen, and the ith sensing line SLi in a floated state is charged with a voltage corresponding to a current Ioled flowing in the turned-on driving transistor Tdr. At this time, a voltage corresponding to the threshold voltage Vth of the driving transistor Tdr is charged into the ith sensing line SLi.

Subsequently, in the sensing period SM_t3, the first gate signal GSa having a gate-off voltage level is supplied to the first gate signal line GLa of the ith gate line GLi according to driving of the gate driver 220, and the second gate signal GSb supplied to the second gate signal line GLb is maintained at the gate-on voltage level. Simultaneously, the ith sensing line SLi which is floated is connected to the sensing data generator 236 through the second switching unit 234 of the data driver 230. Therefore, in the sensing period SM_t3, the sensing data generator 236 senses a voltage charged into the ith sensing line SLi, converts the sensed voltage (i.e., a voltage corresponding to the threshold voltage of the driving transistor Tdr) into digital sensing data Sdata, and supplies the digital sensing data Sdata to the timing controller 210.

Figure 10:
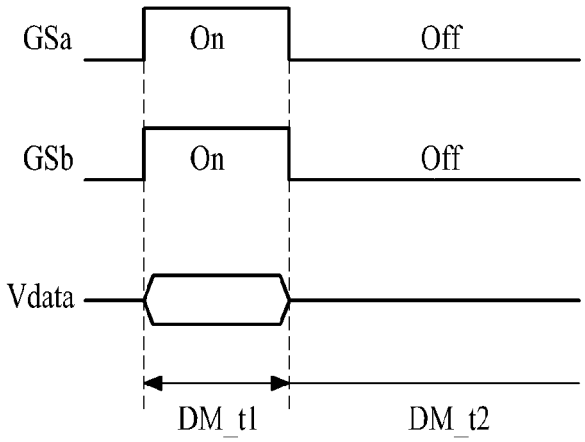
FIG. 10 is a waveform diagram showing a driving waveform in a display mode of the organic light emitting display device according to an embodiment of the present invention.

FIG. 10 is a waveform diagram showing a driving waveform in a display mode of the organic light emitting display device according to an embodiment of the present invention.

Driving of an ith pixel P connected to the ith gate line GLi in the display mode will be described with reference to FIGS. 2, 8 and 10.

First, the timing controller 210 corrects input data RGB on the basis of sensing data Sdata of each pixel P which is sensed in the sensing mode and is stored in the memory. Also, the timing controller detects the threshold voltage of the driving transistor Tdr included in the ith pixel P on the basis of the sensing data Sdata of the ith pixel P, and when the detected threshold voltage of the driving transistor Tdr deviates from the normal compensation range, the timing controller 210 generates upper gate voltage data Tdata for restoring the threshold voltage of the driving transistor to a threshold voltage which is within the normal compensation range, and supplies the upper gate voltage data Tdata to the voltage supply unit 300. The voltage supply 300 generates an upper gate voltage Vtg corresponding to the upper gate voltage data Tdata, and supplies the upper gate voltage Vtg to an ith upper gate voltage line TGLi. In addition, the timing controller 210 controls the gate driver 220 and the data driver 230 in the display mode, and drives each pixel P in a data charging period DM_t1 and an emission period DM_t2.

In the data charging period DM_t1, the first and second gate signals GSa and GSb having the gate-on voltage level are respectively supplied to the first and second gate signal lines GLa and GLb of the ith gate line GLi according to driving of the gate driver 220, a display data voltage Vdata is supplied to an ith data line DLi according to driving of the data driver 230, and simultaneously, the reference voltage Vref is supplied to an ith sensing line SLi. Therefore, the first and second switching transistors T1 and T2 of an ith pixel P are respectively turned on by the first and second gate signals GSa and GSb, and thus, the display data voltage Vdata is supplied to the first node n1, and the reference voltage Vref is supplied to the second node n2. Therefore, in the data charging period DM_t1, the capacitor Cst is charged with a difference voltage "Vdata−Vref" between the display data voltage Vdata and the reference voltage Vref.

Subsequently, in the emission period DM_t2, the first and second gate signals GSa and GSb having the gate-off voltage level are respectively supplied to the first and second gate signal lines GLa and GLb of the ith gate line GLi according to driving of the gate driver 220. Therefore, in the emission period DM_t2, the first and second switching transistors T1 and T2 of an ith pixel P are respectively turned off by the first and second gate signals GSa and GSb having the gate-off voltage level, and thus, the driving transistor Tdr is turned on by a voltage charged into the capacitor Cst. At this time, in the emission period DM_t2, as seen in FIGS. 5 to 7, the threshold voltage Vth of the turned-on driving transistor Tdr is controlled by the upper gate voltage Vtg applied to the upper gate electrode Tdr_tg, and is shifted to the normal compensation range. Therefore, the turned-on driving transistor Tdr supplies a data current Ioled, which is determined based on the difference voltage "Vdata−Vref" between the display data voltage Vdata and the reference voltage Vref, to the organic light emitting element OLED, thereby allowing the organic light emitting element OLED to emit light in proportion to the data current Ioled which flows from the driving voltage VDD line to a cathode electrode CE. That is, in the emission period DM_t2, when the first and second switching transistors T1 and T2 are turned off, a current flows in the driving transistor Tdr, and the organic light emitting element OLED starts to emit light in proportion to the current, whereby a voltage of the second node n2 increases. A voltage of the first node n1 increases by the voltage of the second node n2 which is increased by the capacitor Cst, and thus, a gate-source voltage Vgs of the driving transistor Tdr is continuously held by a voltage of the capacitor Cst, thereby allowing the organic light emitting element OLED to continuously emit light until a next data charging period DM_t1.

The organic light emitting display device according to the first embodiment of the present invention applies the upper gate voltage Vtg to the upper gate electrode Tdr_tg of the driving transistor Tdr of each pixel P to restore a threshold voltage shift of the driving transistor Tdr of each pixel P to the normal compensation range, thereby enhancing a reliability of the driving transistor Tdr included in each pixel P and the display panel 100.

Figure 11:
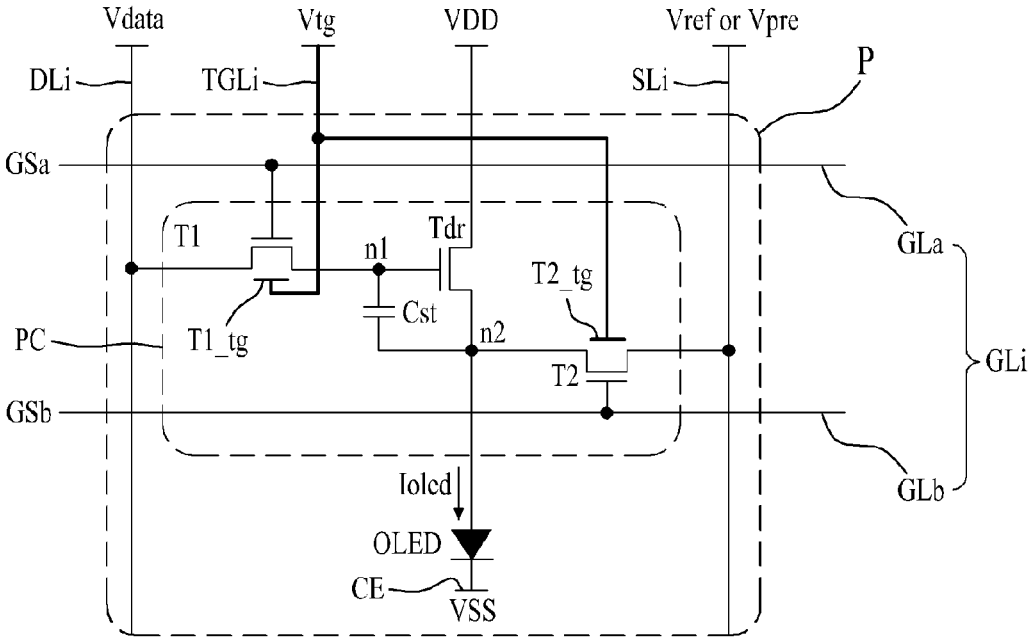
FIG. 11 is a diagram for describing a pixel structure in an organic light emitting display device according to a second embodiment of the present invention.

FIG. 11 is a diagram for describing a pixel structure in an organic light emitting display device according to a second embodiment of the present invention. The pixel structure is implemented by changing a structure of each of the first and second switching transistors T1 and T2. Hereinafter, only elements which differ from the above-described elements will be described.

First, a driving transistor Tdr included in each of a plurality of pixels P includes a gate electrode, a source electrode, and a drain electrode.

A first switching transistor T1, similar to the driving transistor Tdr of FIG. 4, includes a lower gate electrode 111 and an upper gate electrode 117 (T1_tg) which overlap each other with a semiconductor layer 113 therebetween. Here, the lower gate electrode 111 is connected to a first gate signal line GLa adjacent thereto, and the upper gate electrode 117 (T1_tg) is connected to an upper gate voltage line TGLi adjacent thereto. Similar to the driving transistor Tdr, a threshold voltage of the first switching transistor T1 is shifted to have a negative correlation with an upper gate voltage Vtg supplied to the upper gate electrode 117 (T1_tg).

A second switching transistor T2, similar to the driving transistor Tdr of FIG. 4, includes a lower gate electrode 111 and an upper gate electrode 117 (T2_tg) which overlap each other with a semiconductor layer 113 therebetween. Here, the lower gate electrode 111 is connected to a second gate signal line GLb adjacent thereto, and the upper gate electrode 117 (T2_tg) is connected in common to an upper gate voltage line TGLi adjacent thereto and the upper gate electrode 117 (T1_tg) of the first switching transistor T1. A threshold voltage of the second switching transistor T2 is shifted to have a negative correlation with the upper gate voltage Vtg supplied to the upper gate electrode 117 (T2_tg).

The upper gate voltage Vtg is supplied in common to each of the upper gate electrode 117 (T1_tg, T2_tg) of the first and second switching transistor T1 and T2, the upper gate voltage Vtg may be generated from sensing data Sdata, corresponding to the threshold voltage of the driving transistor Tdr which is sensed in the sensing mode, or sensing data Sdata corresponding to a threshold voltage of the second switching transistor T2. Here, the sensing data Sdata corresponding to the threshold voltage of the driving transistor Tdr may be generated by the sensing mode described above with common reference to FIG. 9. The sensing data Sdata corresponding to the threshold voltage of the second switching transistor T2 may be generated by a sensing mode which allows the second switching transistor T2 to operate as a source follower. In this case, the first and second switching transistors T1 and T2 are formed adjacent to each other according to a process of manufacturing a TFT, and thus have similar threshold voltage characteristics. Therefore, in the organic light emitting display device according to the second embodiment of the present invention, threshold voltages of the first and second switching transistors T1 and T2 may be controlled based on the sensing data Sdata corresponding to the threshold voltage of the second switching transistor T2.

The organic light emitting display device according to the second embodiment of the present invention applies the upper gate voltage Vtg to the upper gate electrodes 117 (T1_tg) and (T2_tg) of the first and second switching transistors T1 and T2 of each pixel P to restore a threshold voltage shift of each of the first and second switching transistors T1 and T2 of each pixel P to the normal compensation range, thereby enhancing a reliability of the first and second switching transistors T1 and T2 included in each pixel P and the display panel 100.

Figure 12:
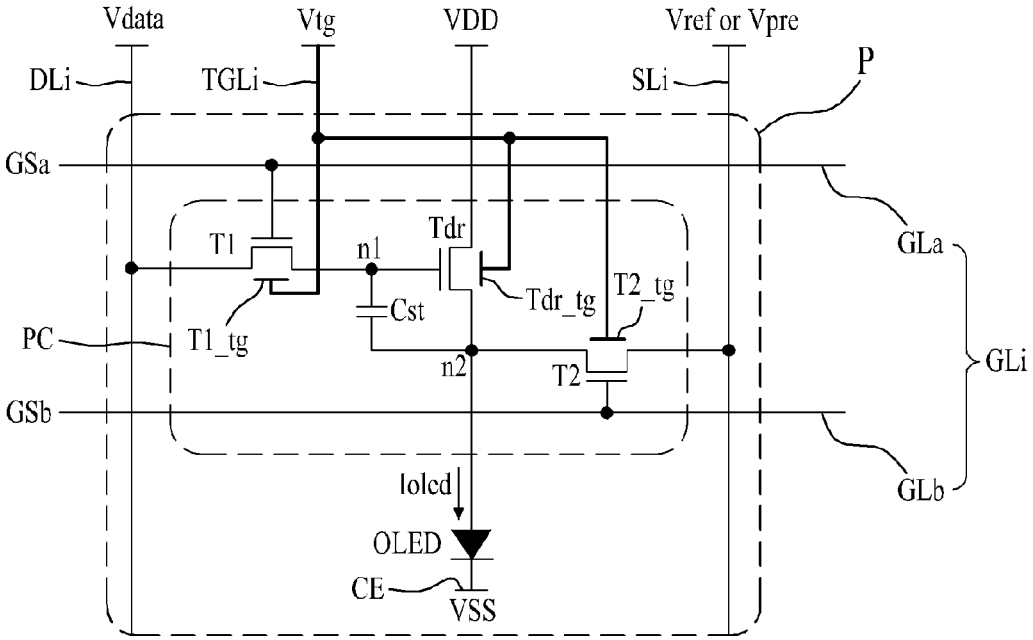
FIG. 12 is a diagram for describing a pixel structure in an organic light emitting display device according to a third embodiment of the present invention.

FIG. 12 is a diagram for describing a pixel structure in an organic light emitting display device according to a third embodiment of the present invention. The pixel structure is implemented by combining the pixel structure of the organic light emitting display device according to the first embodiment of the present invention and the pixel structure of the organic light emitting display device according to the second embodiment of the present invention. Hereinafter, only elements which differ from the above-described elements will be described.

First, a driving transistor Tdr included in each of a plurality of pixels P is configured similar to the driving transistor Tdr of FIG. 4, and thus, its detailed description is not repeated. First and second switching transistors T1 and T2 included in each pixel P are configured similar to those of FIG. 11, and thus, their detailed descriptions are not repeated.

Respective upper gate electrodes Tdr_tg, T1_tg and T2_tg of the driving transistor Tdr and first and second switching transistors T1 and T2 of each pixel P are connected to an upper gate voltage line TGLi adjacent thereto in common. An upper gate voltage Vtg applied to the upper gate voltage line TGLi may be generated based on sensing data Sdata corresponding to a threshold voltage of the driving transistor Tdr which is sensed in the sensing mode.

In FIG. 12, it is illustrated that the respective upper gate electrodes Tdr_tg, T1_tg and T2_tg of the driving transistor Tdr and first and second switching transistors T1 and T2 of each pixel P are connected to an upper gate voltage line TGLi adjacent thereto in common, but the present embodiment is not limited thereto. The upper gate voltage Vtg may be separately applied to the respective upper gate electrodes Tdr_tg, T1_tg and T2_tg of the driving transistor Tdr and first and second switching transistors T1 and T2 through a separate upper gate voltage line.

The organic light emitting display device according to the third embodiment of the present invention applies, in common or separately, the upper gate voltage Vtg to respective upper gate electrodes Tdr_tg, T1_tg and T2_tg of the driving transistor Tdr and first and second switching transistors T1 and T2 of each pixel P to restore a threshold voltage shift of each of the transistors T1, T2 and Tdr of each pixel P to the normal compensation range, thereby enhancing a reliability of the transistors T1, T2 and Tdr included in each pixel P and the display panel 100.

Figure 13:
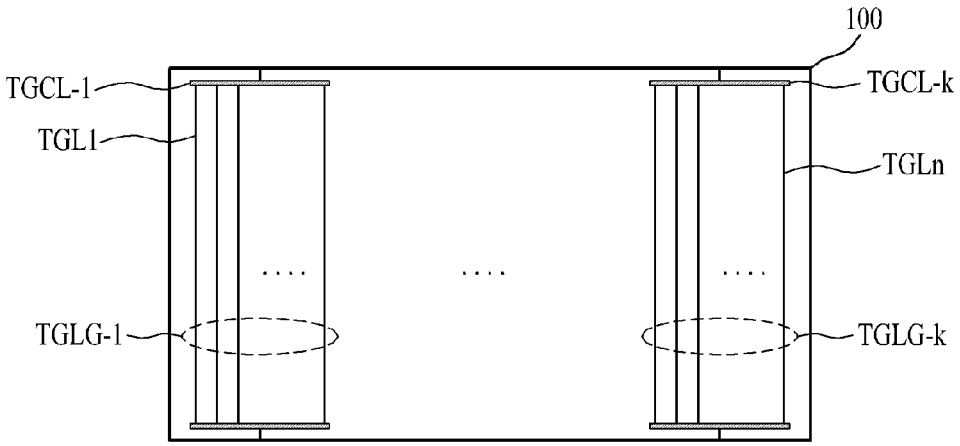
FIG. 13 is a diagram for describing a modification example of a plurality of upper gate voltage lines in the organic light emitting display device according to the first to third embodiments of the present invention.

FIG. 13 is a diagram for describing a modification example of a plurality of upper gate voltage lines in the organic light emitting display device according to the first to third embodiments of the present invention. Hereinafter, only elements which differ from the above-described elements will be described.

The plurality of upper gate voltage lines TGL1 to TGLn are formed in parallel with the plurality of data lines DL1 to DLn, and are grouped into a plurality of upper gate voltage line groups TGLG-1 to TGLG-k (or a plurality of second gate electrode groups). To this end, a plurality of upper gate common lines TGCL-1 to TGCL-k (or a plurality of second gate voltage common lines) are formed in an upper and/or lower non-display area(s) of the display panel 100.

The plurality of upper gate voltage lines included in each of the plurality of upper gate voltage line groups TGLG-1 to TGLG-k are connected to the plurality of upper gate common lines TGCL-1 to TGCL-k in common The upper gate voltage Vtg is supplied from the voltage supply unit 300 to the plurality of upper gate common lines TGCL-1 to TGCL-k.

In order for the upper gate voltage Vtg to be easily applied to the upper gate common lines TGCL-1 to TGCL-k, the number of the upper gate common lines TGCL-1 to TGCL-k may be the same as the number of the data driving ICs 230-1 configuring the data driver 230.

The timing controller 210 may generate the upper gate voltage data Tdata on the basis of an average value of pieces of sensing data Sdata about pixels P included in each of the plurality of upper gate voltage line groups TGLG-1 to TGLG-k, but the present embodiment is not limited thereto. Various algorithms for restoring a threshold voltage shift of each of transistors included in pixels P connected to the upper gate common lines TGCL-1 to TGCL-k may be applied.

Figure 14:
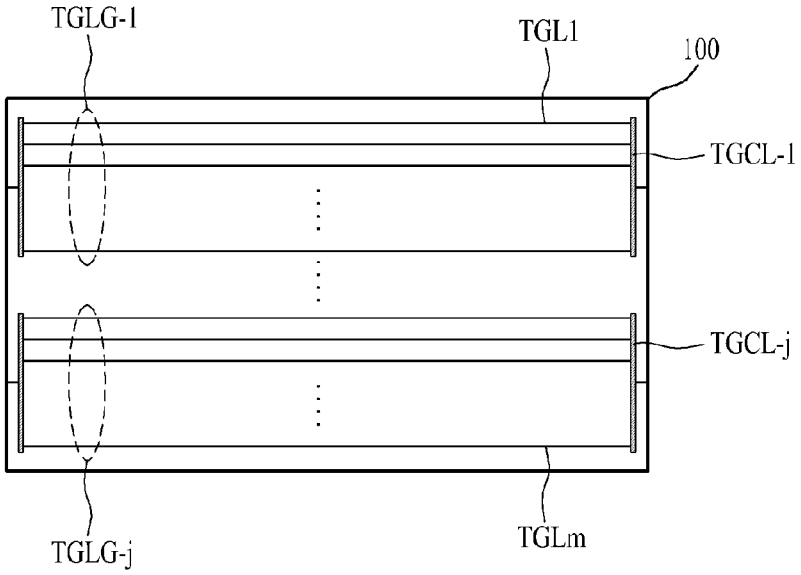
FIG. 14 is a diagram for describing another modification example of a plurality of upper gate voltage lines in the organic light emitting display device according to the first to third embodiments of the present invention.

FIG. 14 is a diagram for describing another modification example of a plurality of upper gate voltage lines in the organic light emitting display device according to the first to third embodiments of the present invention. Hereinafter, only elements which differ from the above-described elements will be described.

The plurality of upper gate voltage lines TGL1 to TGLm are formed in parallel with the plurality of gate lines GL1 to GLm, and are grouped into a plurality of upper gate voltage line groups TGLG-1 to TGLG-j. To this end, a plurality of upper gate common lines TGCL-1 to TGCL-j are formed in the left and/or right non-display area(s) of the display panel 100.

The plurality of upper gate voltage lines included in each of the plurality of upper gate voltage line groups TGLG-1 to TGLG-j are connected to the plurality of upper gate common lines TGCL-1 to TGCL-j in common The upper gate voltage Vtg is supplied from the voltage supply unit 300 to the plurality of upper gate common lines TGCL-1 to TGCL-j.

In order for the upper gate voltage Vtg to be easily applied to the upper gate common lines TGCL-1 to TGCL-j, the number of the upper gate common lines TGCL-1 to TGCL-j may be the same as the number of the gate driving ICs configuring the gate driver 220.

Hereinabove, it has been described that the timing controller 210 generates the gate voltage data Tdata for restoring the threshold voltage of the driving transistor Tdr, which deviates from the normal compensation range, to the normal compensation range on the basis of the sensing data Sdata of each pixel P, but the present embodiment is not limited thereto. The timing controller 210 may generate the gate voltage data Tdata for restoring the threshold voltage of the driving transistor Tdr to an initial state on the basis of the sensing data Sdata of each pixel P.

Moreover, it has been described above that each of the transistors T1, T2 and Tdr of each pixel is formed of an N-type TFT, but the present embodiment is not limited thereto. For example, each of the transistors T1, T2 and Tdr of each pixel may be formed of a P-type TFT. Also, it has been described above that the pixel circuit PC of each pixel includes the first and second switching transistors T1 and T2 and the driving transistor Tdr, but the present embodiment is not limited thereto. For example, the pixel circuit PC of each pixel may include one or more capacitors and three or more transistors which sense a threshold voltage of the transistor included in each pixel in an external sensing mode.

As described above, in the organic light emitting display device according to the embodiments of the present invention, the upper gate electrode is formed in a transistor included in each pixel, and a threshold voltage shift of the transistor included in each pixel is restored by applying the upper gate voltage to the upper gate electrode, thereby enhancing a reliability of the transistor included in each pixel and the display panel.

It will be apparent to those skilled in the art that various modifications and variations can be made in the present invention without departing from the spirit or scope of the inventions. Thus, it is intended that the present invention covers the modifications and variations of this invention provided they come within the scope of the appended claims and their equivalents.

What is claimed is:

1. An organic light emitting display device comprising:

a display panel including a plurality of pixels, which are respectively formed in a plurality of pixel areas defined by crossings of a plurality of gate lines and a plurality of data lines, a plurality of sensing lines, and a plurality of second gate voltage lines connected to the plurality of pixels, wherein each of the plurality of pixels includes at least one transistor including first and second gate electrodes which overlap each other with a semiconductor layer therebetween;

a panel driver to drive the display panel in a display mode or a sensing mode, to sense a threshold voltage of the at least one transistor included in each of the plurality of pixels through the plurality of sensing lines to generate a sensing data in the sensing mode, and generate a second gate voltage data based on the sensing data of each pixel in the display mode; and a voltage supply unit to generate a second gate electrode voltage corresponding to the second gate voltage data supplied from the panel driver, and apply the second gate electrode voltage to the second gate electrode of the at least one transistor, included in each pixel, through a corresponding second gate voltage line.

2. The organic light emitting display device of claim 1, wherein the panel driver corrects input data of each pixel to correction data through data correction based on the sensing data of each pixel, and displays the correction data in each pixel.

3. The organic light emitting display device of claim 2, wherein, the panel driver detects a threshold voltage shift of the at least one transistor from the sensing data, and when the detected threshold voltage shift of the at least one transistor deviates from a compensation range based on the data correction, the panel driver generates the second gate voltage data.

4. The organic light emitting display device of claim 1, wherein, each of the plurality of pixels comprises an organic light emitting element and a pixel circuit configured to allow the organic light emitting element to emit light, and the pixel circuit comprises:

a driving transistor configured to include the first and second gate electrodes, and control an amount of current flowing in the organic light emitting element;

a first switching transistor connected between an adjacent data line and the first gate electrode of the driving transistor to turn on according to a first gate signal;

a second switching transistor connected between a source electrode of the driving transistor and an adjacent sensing line to turn on according to a second gate signal; and a storage capacitor connected between the first gate electrode and source electrode of the driving transistor.

5. The organic light emitting display device of claim 4, wherein, in the sensing mode, the panel driver senses a threshold voltage of the driving transistor through a corresponding sensing line to generate sensing data of each of the plurality of pixels, and in the display mode, the panel driver generates the second gate voltage data, based on the sensing data of each pixel.

6. The organic light emitting display device of claim 5, wherein, each of the first and second switching transistors comprises the first gate electrode receiving a corresponding gate signal and the second gate electrode receiving the second gate electrode voltage, and the second gate electrode voltage is applied, in common or separately, to the driving transistor and the second gate electrode of each of the first and second switching transistors.

7. The organic light emitting display device of claim 1, wherein, each of the plurality of pixels comprises an organic light emitting element and a pixel circuit configured to allow the organic light emitting element to emit light, the pixel circuit comprises:

a driving transistor configured to control an amount of current flowing in the organic light emitting element;

a first switching transistor connected between an adjacent data line and a gate electrode of the driving transistor to turn on according to a first gate signal;

a second switching transistor connected between a source electrode of the driving transistor and an adjacent sensing line to turn on according to a second gate signal; and a storage capacitor connected between the gate electrode and source electrode of the driving transistor, and each of the first and second switching transistors comprises the first gate electrode receiving a corresponding gate signal and the second gate electrode receiving the second gate electrode voltage.

8. The organic light emitting display device of claim 7, wherein, in the sensing mode, the panel driver senses a threshold voltage of the second switching transistor through a corresponding sensing line to generate sensing data of each of the plurality of pixels, and in the display mode, the panel driver generates the second gate voltage data, based on the sensing data of each pixel.

9. The organic light emitting display device of claim 1, wherein the plurality of second gate voltage lines are formed in parallel with the plurality of data lines or the plurality of gate lines.

10. The organic light emitting display device of claim 8, wherein, the plurality of second gate voltage lines are grouped into a plurality of groups, and the display panel further comprises a plurality of second gate voltage common lines connected in common to a plurality of second gate voltage lines included in each of the plurality of groups.

11. A method of driving an organic light emitting display device comprising:

supplying a first gate signal and a second gate signal having a gate-on voltage level, to a first gate signal line and a second gate signal line of an $i^{th}$ gate line according to a gate driver respectively;

supplying a sensing data voltage to an $i^{th}$ data line according to a data driver and simultaneously supplying a precharging voltage to an $i^{th}$ sensing line, wherein a first switching transistor and a second switching transistor of an $i^{th}$ pixel are respectively turned on by the first and second gate signals, and wherein the sensing data voltage is supplied to a first node, and the precharging voltage is supplied to a second node;

continuously supplying the sensing data voltage to the $i^{th}$ data line and simultaneously floating the $i^{th}$ sensing line;

turning on a driving transistor by a difference voltage between the sensing data voltage and the precharging voltage, and charging the $i^{th}$ sensing line, in the floated state, with a voltage corresponding to a current flowing in the turned-on driving transistor;

supplying the first gate signal having a gate-off voltage level to the first gate signal line, and maintaining the second gate signal to the second gate signal line at the gate-on voltage level;

sensing a voltage charged into the $i^{th}$ sensing line and converting the sensed voltage into digital sensing data;

supplying the digital sensing data to a timing controller;

correcting an input data at the timing controller on the basis of the sensing data; and detecting the threshold voltage of the driving transistor included in the $i^{th}$ pixel on the basis of the sensing data of the $i^{th}$ pixel, wherein when the detected threshold voltage of the driving transistor deviates from a normal compensation range, the timing controller generates an upper gate voltage data for restoring the threshold voltage of the driving transistor to a threshold voltage which is within the normal compensation range, and supplies the upper gate voltage data to a voltage supply unit.

12. The method of driving an organic light emitting display device of claim 11, wherein, a capacitor is precharged with the difference voltage between the sensing data voltage and the precharging voltage.

13. The method of driving an organic light emitting display device of claim 11, wherein a voltage corresponding to the threshold voltage of the driving transistor is charged into the $i^{th}$ sensing line.

14. The method of driving an organic light emitting display device of claim 11, further comprising:

supplying the first and second gate signals respectively having the gate-on voltage level to the first and second gate signal lines of the $i^{th}$ gate line according the gate driver;

supplying a display data voltage to the $i^{th}$ data line according to the data driver; and simultaneously, supplying the reference voltage to the $i^{th}$ sensing line, wherein, the first and second switching transistors of the $i^{th}$ pixel are respectively turned on by the first and second gate signals, and thus, the display data voltage is supplied to a first node, and the reference voltage is supplied to a second node.

15. The method of driving an organic light emitting display device of claim 14, wherein, the capacitor is charged with a difference voltage between the display data voltage and the reference voltage.

16. The method of driving an organic light emitting display device of claim 15, further comprising:

supplying the first and second gate signals respectively, having the gate-off voltage level, to the first and second gate signal lines of the $i^{th}$ gate line according to the gate driver, wherein, the first and second switching transistors of the $i^{th}$ pixel are respectively turned off by the first and second gate signals having the gate-off voltage level, and thus, the driving transistor is turned on by a voltage charged into the capacitor.

17. The method of driving an organic light emitting display device of claim 16, further comprising:

generating an upper gate voltage based on the upper gate voltage data according to the voltage supply unit;

controlling the threshold voltage of the turned-on driving transistor by the upper gate voltage applied to the upper gate electrode;

shifting the threshold voltage to the normal compensation range; and supplying a data current by the turned-on driving transistor, to an organic light emitting element included in the $i^{th}$ pixel, wherein the organic light emitting element emits light in proportion to the data current which flows from the driving voltage line to a cathode electrode.

* * * * *